United States Patent [19]

Montgomery et al.

[11] Patent Number: 4,958,485

[45] Date of Patent: Sep. 25, 1990

[54] CORESPUN YARN FOR FIRE RESISTANT SAFETY APPAREL

[75] Inventors: Terry G. Montgomery, Matthews, N.C.; William G. Martin, Fort Mill, S.C.

[73] Assignee: Springs Industries, Inc., Fort Mill, S.C.

[21] Appl. No.: 288,682

[22] Filed: Dec. 22, 1988

[51] Int. Cl.[5] ..... D02G 3/02; D02G 3/04; D02G 3/36

[52] U.S. Cl. ..... 57/210; 57/5; 57/224; 57/230; 57/904; 428/377

[58] Field of Search ..... 57/210, 224, 230, 5, 57/6, 12, 904; 428/373, 377

[56] References Cited

U.S. PATENT DOCUMENTS

| | | | |
|---|---|---|---|
| 2,992,150 | 7/1961 | Goy | 57/210 X |
| 3,572,397 | 3/1971 | Austin | 139/426 R |
| 3,913,309 | 10/1975 | Chiarotto | 57/229 |
| 4,069,656 | 1/1978 | Arai et al. | 57/6 |
| 4,070,818 | 1/1978 | Hamel | 57/12 |
| 4,107,909 | 8/1978 | Fehrer et al. | 57/5 |
| 4,202,382 | 5/1980 | Westhead | 57/230 X |
| 4,249,368 | 2/1981 | Fehrer | 57/5 |
| 4,257,221 | 3/1981 | Feinberg | 57/256 |
| 4,274,448 | 6/1981 | Westhead | 57/210 X |
| 4,327,545 | 5/1982 | Fehrer | 57/5 |
| 4,327,779 | 5/1982 | Westhead | 57/210 X |
| 4,331,729 | 5/1982 | Weber | 428/252 |
| 4,381,639 | 5/1983 | Kress | 57/229 |
| 4,500,593 | 2/1985 | Weber | 428/257 |
| 4,541,231 | 9/1985 | Graham, Jr. et al. | 57/12 |
| 4,573,500 | 3/1986 | Bouglas | 139/426 R |
| 4,614,081 | 9/1986 | Kim | 57/12 |
| 4,670,327 | 6/1987 | Weber | 428/257 |

*Primary Examiner*—John Petrakes

*Attorney, Agent, or Firm*—Bell, Seltzer, Park & Gibson

[57] ABSTRACT

The corespun yarn is formed on a friction spinning apparatus and comprises three components, including a core of high temperature resistant fibers, a core wrapper of low temperature resistant fibers surrounding and covering the core, and an outer sheath of low temperature resistant fibers surrounding and covering the core wrapper and the core. The high temperature resistant fibers of the core are selected from the group consisting essentially of aramid fibers (Kevlar and Nomex), and polybenzimidazole fibers (PBI). The low temperature resistant fibers of the core wrapper and the outer sheath are either natural or synthetic fibers, such a cotton and polyester. The corespun yarn is knitted or woven into a fabric and subjected to a high temperature flame environment, the low temperature resistant fibers of the core wrapper and the outer sheath are charred but do not melt, drip or exhibit afterflame or afterglow, and the charred portion remains in position around the core and maintains the same type of flexiblity and integrity as the unburned fabric.

8 Claims, 2 Drawing Sheets

CORESPUN YARN FOR FIRE RESISTANT SAFETY APPAREL

FIELD OF THE INVENTION

This invention relates generally to corespun yarn for forming fabric useful in the production of fire resistant safety apparel and more particularly to such a corespun yarn which includes a core of high temperature resistant fibers, a core wrapper of low temperature resistant fibers surrounding and covering the core, and an outer sheath of low temperature resistant fibers surrounding and covering the core wrapper.

BACKGROUND OF THE INVENTION

It is generally known to form heat resistant fabrics of various types of yarns. For example, hazardous industrial work uniforms, firefighter uniforms, and military protective uniforms have been formed of fabrics fabricated of yarns formed of non-synthetic fibers, such as cotton or wool. These fabrics are then topically treated with conventional halogen-based and/or phosphorous-based fire retarding chemicals. However, uniforms formed of this type of fabric have a limited wear life, and are heavier in weight than non-flame retardant uniform fabrics, the chemical treatment typically adding about 15% to 20% to the weight of the fabric. When this type of fabric is burned, it forms brittle chars which break away with movement of the fabric.

Also, it is known to form fire resistant garments of fabrics fabricated of yarns formed entirely of nonburning or high temperature resistant fibers or blends of nonburning fibers, such as Nomex, Kevlar or PBI. These fabrics do exhibit thermal stability but are very expensive to produce, and do not have the comfort, moisture absorbency, and dyeability characteristics of fabrics formed of natural fiber yarns.

U.S. Pat. Nos. 4,381,639; 4,500,593; and 4,670,327 disclose yarns for forming heat resistant fabrics which include a core of continuous glass filaments covered by a layer of heat-resisting aramid fibers. However, the yarns and fabrics disclosed in these patents are very expensive to produce because of the high cost of the fibers required to produce these yarns and fabrics. Also, the yarns and fabrics disclosed in these patents have the surface characteristics of the aramid fibers so that these fabrics do not have the desirable surface characteristics of dyeability and comfort of fabrics formed of conventional natural fibers, such as cotton, wool or the like.

U.S. Pat. No. 4,331,729 discloses a heat resistant fabric formed of a yarn including a core of carbon filaments and a cover of aramid fibers. The yarn and heat resistant fabric disclosed in this patent also includes the same type of disadvantages as pointed out in the above discussion of prior art patents.

SUMMARY OF THE INVENTION

In contrast to the above-discussed prior art, the corespun yarn of the present invention provides fabric for forming fire resistant safety apparel having the appearance, feel, dyeability, and comfort characteristics of conventional types of fabrics formed of conventional natural fibers and not including fire resistant characteristics.

The corespun yarn of the present invention includes a core of high temperature resistant fibers, a core wrapper of low temperature resistant fibers surrounding and covering the core, and an outer sheath of low temperature resistant fibers surrounding and covering the core wrapper. The high temperature resistant fibers forming the core are aramid fibers, such as Kevlar or Nomex, or polybenzimidazole fibers, such as PBI. The low temperature resistant fibers of the core wrapper and the outer sheath may be either natural or synthetic, such as cotton, wool, polyester, modacrylic, or blends of these fibers. The fibers of the core and the core wrapper extend primarily in the axial direction and longitudinally of the corespun yarn to impart high tensile strength to the yarn. The fibers of the outer sheath extend primarily in a circumferential direction around the corespun yarn and impart the conventional type of surface characteristics to the corespun yarn and the fabric formed therefrom.

The core of high temperature resistant fibers constitutes about 20% to 25% of the total weight of the corespun yarn, the core wrapper of low temperature resistant fibers constitutes about 30% to 65% of the total weight of the corespun yarn, and the outer sheath of low temperature resistant fibers constitutes about 20% to 50% of the total weight of the corespun yarn. It is preferred that the high temperature resistant fibers of the core constitute about 20% of the total weight, the core wrapper of low temperature resistant fibers constitute about 30% of the total weight, and the outer sheath of low temperature resistant fibers constitute about 50% of the total weight of the corespun yarn.

The corespun yarn is preferably formed on a DREF friction spinning apparatus in which a core roving is guided onto a core wrapper sliver and then passed through a succession of draw rolls so that the core wrapper surrounds and extends along the core roving. The core and the core wrapper are then passed through an elongated throat formed between a pair of perforated suction drums which are rotated in the same direction. As the core and core wrapper pass between the suction drums, the fibers forming the outer sheath are fed thereto to surround and cover the core wrapper and the core. In accordance with the present invention, the conventional DREF friction spinning apparatus is modified so that the entrance trumpet for the drafting section includes an additional guide passageway for the core roving positioned above and centrally of a guide passageway for the core wrapper sliver to insure that the core roving is positioned in the center and on top of the core wrapper sliver as both of these components pass through the succession of draw rolls in the drafting section.

Since the corespun yarn of the present invention contains a small percentage by weight of high temperature resistant fibers, preferably about 20%, the corespun yarn of the present invention can be produced at a much more economical cost than fire resistant fabrics formed of yarns including large percentages by weight of expensive high temperature resistant fibers. When fabrics formed of the corespun yarn of the present invention are exposed to high heat and flame, the core wrapper and outer sheath fibers are charred but remain in position around the high temperature resistant core to provide a thermal insulation barrier. This provides an insulating air layer between the skin and the fabric. This characteristic is important in a fire situation in which a firefighter wearing a shirt made from this fabric would continue to be thermally protected by the insulating air layer between his clothing and skin, which remains intact even though the core wrapper fibers and outer sheath fibers will become charred.

Fabrics woven or knit from the corespun yarns of the present invention may be dyed, printed and topically treated with conventional flame retardant chemicals in a manner similar to the flame retardant treatment applied to fabrics produced of 100% cotton fibers. However, the weight added to the fabric by the flame retardant treatment is substantially reduced, to about 10% to 12%, because the core of high temperature resistant fibers does not absorb the flame retardant chemicals. The fabric formed of the corespun yarn of the present invention does not melt, drip, or exhibit afterflame or afterglow when burned. The charred outer portion of the fabric maintains the flexibility and integrity of the unburned portion of the fabric.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 1:
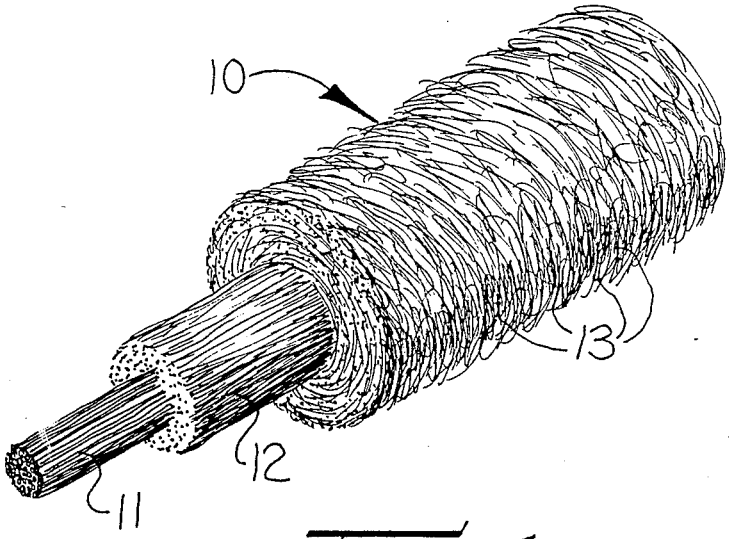
FIG. 1 is a greatly enlarged view of a fragment of the corespun yarn of the present invention with portions of the outer sheath and core wrapper being removed at one end portion thereof.

The corespun yarn of the present invention, broadly indicated at 10 in FIG. 1, includes a core 11 of high temperature resistant fibers, a core wrapper 12 of low temperature resistant fibers surrounding and covering the core 11, and an outer sheath 13 of low temperature resistant fibers surrounding and covering the core wrapper 12. As indicated in FIG. 1, the fibers of the core 11 and the core wrapper 12 extend generally in an axial direction and longitudinally of the corespun yarn 10 and thereby enhance the tensile strength of the yarn. On the other hand, the fibers of the outer sheath 13 extend in generally a circumferential direction around the yarn so that the outer surface of the yarn has the appearance and general characteristics of a conventional corespun yarn.

The high temperature resistant fibers of the core 11 are selected from the group consisting essentially of aramid fibers, such as Kevlar and Nomex, and polybenzimidazole fibers, such as PBI, or a mixture or blend of these fibers. The low temperature resistant fibers of the core wrapper 12 and the outer sheath 13 may be either natural or synthetic, such as cotton, wool, polyester, modacrylic, rayon, or blends of these fibers, as will be pointed out in the examples given below.

The core 11 of high temperature resistant fibers constitutes about 20% to 25% of the total weight of the corespun yarn 10, the core wrapper 12 of low temperature resistant fibers constitutes about 30% to 65% of the total weight of the corespun yarn 10, and the outer sheath 13 of low temperature resistant fibers constitutes about 20% to 50% of the total weight of the corespun yarn 10. It is preferred that the high temperature resistant fibers of the core 11 constitute about 20% of the total weight, the core wrapper of low temperature resistant fibers constitute about 30% of the total weight, and the outer sheath of low temperature resistant fibers constitute about 50% of the total weight of the corespun yarn 10. As will be pointed out in the examples below, the fibers of the core wrapper 12 and the outer sheath 13 may be of the same or of different types.

The core 11 may be formed entirely of aramid fibers or may be formed of a blend of these fibers with polybenzimidazole fibers. The core wrapper 12 surrounds and covers the core 11 so that the fibers forming the core 11 are completely hidden from view in the woven fabric. The core wrapper 12 also provides an ideal working surface for the frictional wrapping process where the fibers of the outer sheath 13 are wrapped around the core wrapper 12. By forming the corespun yarn 10 of the three components, the core 11, the core wrapper 12, and the outer sheath 13, greatly enhanced spinning efficiencies are provided and the resulting yarn has at least a 55% improvement in yarn strength over corespun yarns produced under normal conditions.

Figure 3:
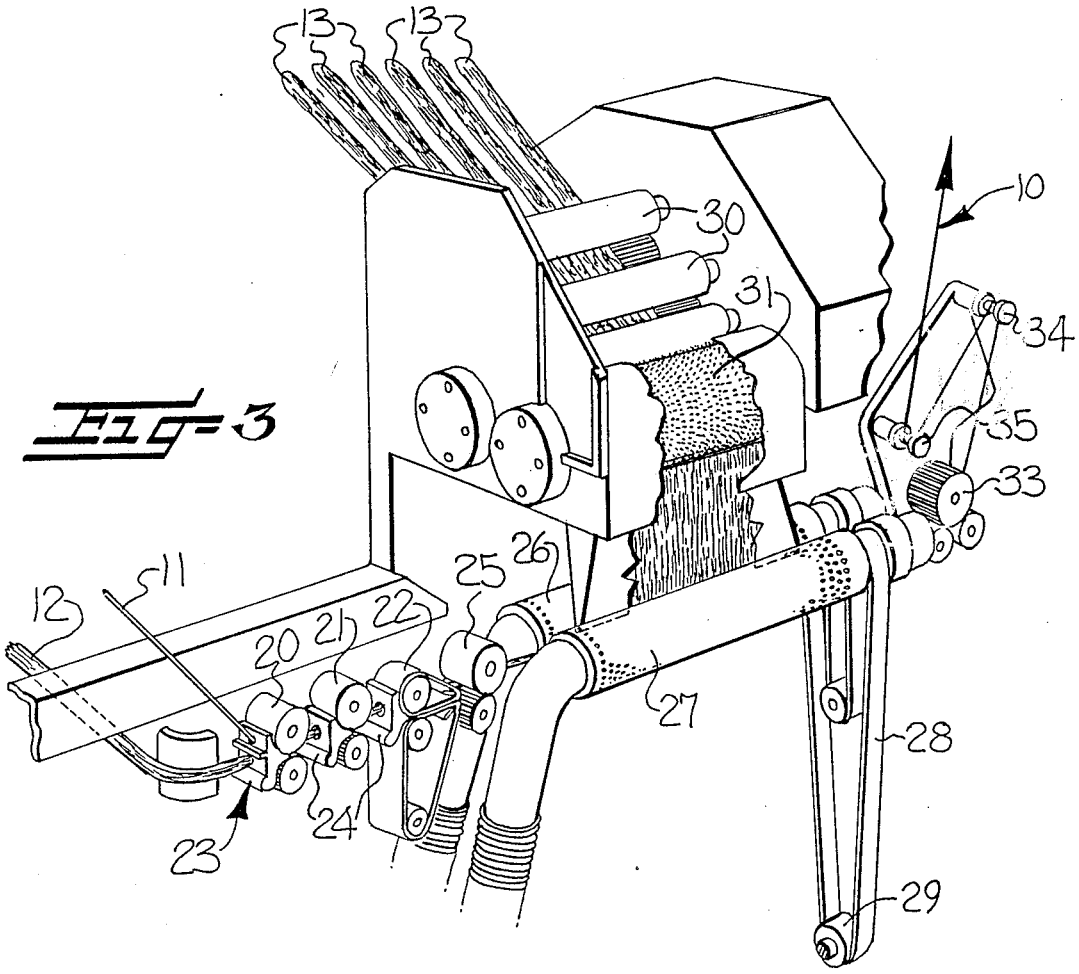
FIG. 3 is a fragmentary isometric view of a portion of a DREF friction spinning apparatus, modified in accordance with the present invention.

The corespun yarn 10 is produced on a DREF friction spinning apparatus of the type illustrated in FIG. 3. This type of friction spinning machine is disclosed in U.S. Pat. Nos. 4,107,909; 4,249,368; and 4,327,545. The friction spinning apparatus includes a core and core wrapper drafting section having a succession of pairs of drafting or draw rolls 20, 21 and 22 with a modified type of entrance trumpet 23 positioned in the nip of the first set of drafting rolls 20. Conventional trumpets 24 are positioned in the nips of the successive pairs of drafting rolls 21, 22. A set of delivery rolls 25 is provided at the exit end of the drafting section and operate to deliver and guide the yarn into an elongated throat formed between a pair of perforated suction drums 26, 27 which are rotated in the same direction by a drive belt 28 and a drive pulley 29.

A plurality of sheath fiber slivers 13 is guided downwardly into draw frame rolls 30, between carding drums 31 and then fed into the elongated throat formed between the pair of perforated suction drums 26, 27 to be wrapped around the outer surface of the yarn. As the yarn leaves the exit end of the elongated throat between the pair of perforated suction drums 26, 27, it passes between withdrawing rolls 33 and is directed over and under yarn guides 34, 35 and to the conventional take-up mechanism of the apparatus, not shown.

Figure 4:
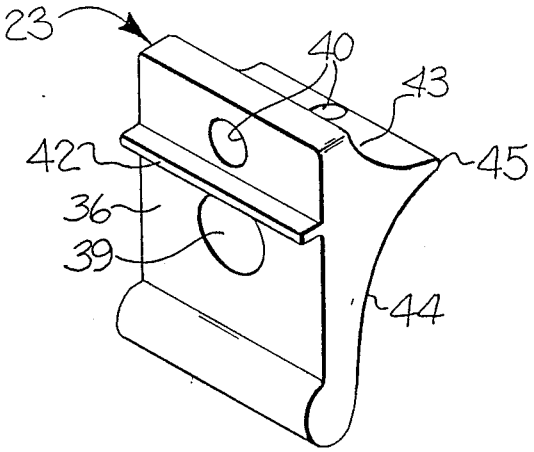
FIG. 4 is an enlarged isometric view of the entrance trumpet, removed from the spinning apparatus, and illustrating the upper guide passageway for the core roving and the lower guide passageway for the core wrapper sliver.
Figure 5:
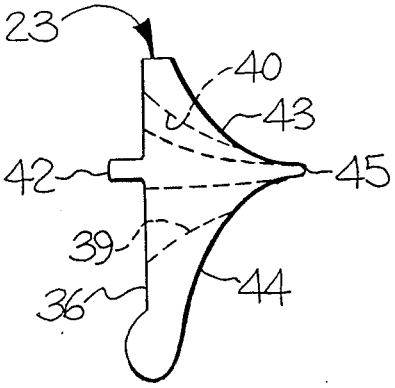
FIG. 5 is a side elevational view of the entrance trumpet shown in FIG. 4.

As illustrated in FIGS. 4 and 5, the modified entrance yarn trumpet 23 includes a lower yarn guide passageway 39 through which a core wrapper sliver 12 is directed, and an upper yarn guide passageway 40 through which a yarn core roving 11 is directed. The planar front face of the entrance trumpet 23 is provided with an integrally formed and outwardly extending horizontal guide rib or bar 42 which serves to maintain separation of the fibers of the core roving 11 and the core wrapper sliver 12 as they move into the respective guide passageways 40, 39 of the entrance trumpet 23.

In the formation of the present corespun yarn 10 on the apparatus of the type illustrated in FIGS. 3–5, the core wrapper sliver 12 is guided into the lower guide passageway 39 of the entrance trumpet 23 while the core roving 11 is directed downwardly and on top of the center of the core wrapper sliver 12 by the guide passageway 40 so that they both pass through the succession of drafting rolls 20, 21 and 22. The fibers of the core wrapper 12 surround the fibers of the core 11 and are drafted in the drafting section of the spinning apparatus. As the core wrapper 12 and core 11 move forwardly from the delivery rolls 25 and through the friction spinning section formed by the elongated throat between the perforated suction drums 26, 27, the fibers of the outer sheath 13 are wrapped around the same in a substantially circumferential direction so that the outer sheath 13 completely covers and surrounds the core wrapper 12 and the core 11. The yarn is then moved through the exit end of the friction spinning section by the withdrawing rolls 33 and is directed onto the take-up package, not shown.

The following non-limiting examples are set forth to demonstrate the types of fibers which may be utilized in the formation of the corespun yarn and to illustrate the various types of fire resistant fabrics which may be provided in accordance with the present invention.

EXAMPLE 1

A core roving 11 comprising 40% PBI fibers and 60% Kevlar fibers, and having a weight necessary to achieve 20% in overall yarn weight, is fed into the upper passageway 40 of the entrance trumpet 23. A core wrapper sliver 12 comprising 100% cotton staple fibers, and having a weight necessary to achieve 30% in overall yarn weight, is fed through the lower passageway 39 in the entrance trumpet 23. A plurality of sheath slivers 13, comprised entirely of cotton fibers, is fed into the draw frame rollers 30 and in an amount sufficient to achieve 50% in overall yarn weight. The resulting corespun yarn 10 is woven into both the warp and filling to form a 5.5 ounce plain weave fabric, of the type generally illustrated in FIG. 2. This woven fabric is dyed and subjected to a topical fire resistant chemical treatment, and a conventional durable press resin finish is then applied thereto. The resulting fabric exhibits durable press ratings of 3.0+ after one wash, and 3.0 after five washes. This fabric also exhibits colorfastness when subjected to a carbon arc light source of a 4–5 rating at 40 hours exposure. This fabric is then subjected to a National Fire Prevention Association test method (NFPA 701) which involves a vertical burn of 12 second duration to a Bunsen burner flame and the fabric exhibits char lengths of less than 1.5 inches with no afterflame or afterglow. In accordance with Federal Test Method 5905, a vertical burn of two 12 second exposures to a high heat flux butane flame shows 22% consumption with 0 seconds afterflame, as compared with 45% consumption and 6 seconds afterflame for a 100% Nomex III fabric of similar weight and construction. Hot air shrinkage of the corespun fabric was tested in a heated chamber at 468° F. for five minutes and shrinkage was less than 1% in both warp and filling directions.

Figure 2:
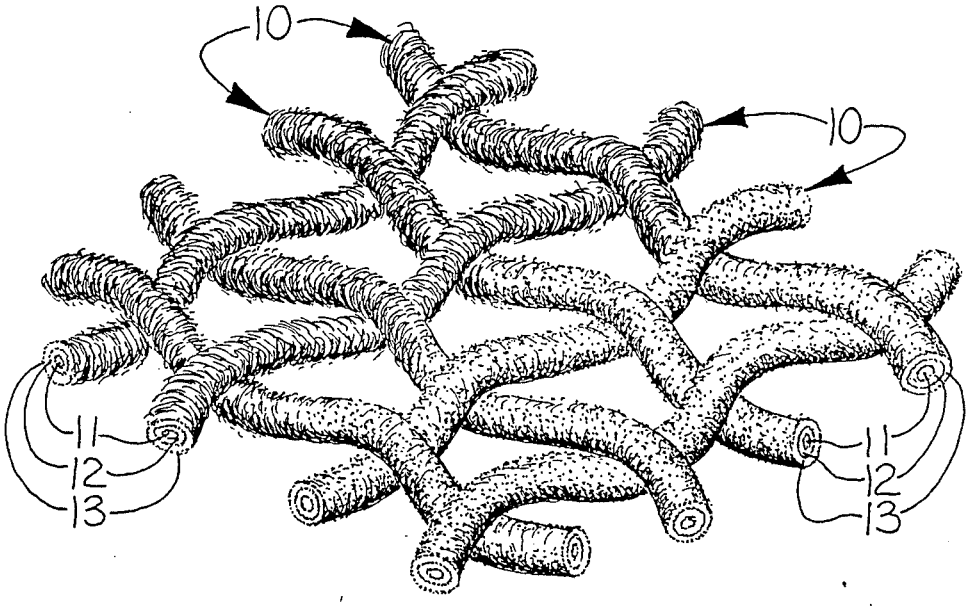
FIG. 2 is a greatly enlarged isometric view of a fragmentary portion of a fabric woven of the yarn of FIG. 1, with the right-hand portion having been exposed to a flame.

Throughout all burn tests, the areas of the fabric char remain flexible and intact, exhibiting no brittleness, melting, or fabric shrinkage. The portion of the fabric illustrated in the right-hand portion of FIG. 2 is speckled to indicate an area which has been subjected to a burn test and to illustrate the manner in which the low temperature resistant fibers become charred but remain in position surrounding the core of high temperature resistant fibers. Thus, even the burned portion of the fabric remains in position in a charred condition and maintains the flexibility and integrity of the unburned portion of the fabric, as illustrated by the fibers surrounding the yarns in the left-hand portion of FIG. 2. The charred fibers of the outer sheath 13 and the core wrapper 12 remaining in position around the core 11 provide a thermal insulation barrier and an insulating air layer between the skin and the fabric, when the fabric is utilized to form a firefighter's shirt, or the like.

EXAMPLE 2

A uniform fabric, of the type described in Example 1, is printed with a woodland camouflage print utilizing print pastes typical of those used to print 100% cotton woven fabric. The fabric is then flame retardant finished with a conventional halogen-based and/or phosphorous-based fire retarding chemical treatment, and a durable press resin treatment is applied thereto. Physical and thermal results were very similar to those set forth in Example 1. This ease of printing, particularly military camouflage prints, on fabrics with this level of thermal protection is not currently possible.

EXAMPLE 3

Corespun yarn is formed in the manner described in FIG. 1 except that self extinguishing fibers (SEF), modacrylic fibers, are substituted for the 100% cotton fibers to form the outer sheath 13. This corespun yarn is woven into a fabric in the same manner as described in FIG. 1 and it is then possible to prepare and dye this fabric using standard International Orange dye formulations developed for 100% acrylic fabrics because the acrylic fibers are positioned on the outside of the yarn in the woven fabric. Comparable fire resistant fabrics of 100% Nomex must either be producer-dyed or solvent-dyed to achieve the International Orange colors at very high raw material cost.

EXAMPLE 4

Corespun yarn is produced in the manner described in Example 1 but instead of using 40/60 PBI/Kevlar core components, the core 11 is formed entirely of staple Kevlar fibers. This corespun yarn is then woven into a fabric and dyed. Flame retardant and durable press finishes are then applied as described in Example 1. Fabric physical parameters and thermal performance are similar to those found in the fabric of Example 1. Further raw material cost reduction is realized over Example 1 because of the current relatively high price of PBI over the cost of Kevlar. Also, the additional Kevlar within the core 11, as compared with Example 1, increases the tensile and tear performance of the fabric by an additional 25%.

EXAMPLE 5

Corespun yarn is formed in the manner described in FIG. 1, but in place of the 100% outer cotton sheath 13, a 50/50 polyester/cotton sheath 13 is substituted therefor. The corespun yarn is woven into a fabric of the type described in FIG. 1 and dyed in a manner typical of 50/50 polyester/cotton blends. The fabric is then flame resistant treated (with flame retardant components which treat both cotton and polyester) and a durable pressed treatment is applied thereto. This fabric exhibits increased abrasion resistance and durable press properties over the similar properties of the fabric of Example 1, while maintaining excellent thermal properties. Due to the lattice of nonburning fibers in the core 11, no melting or melt drip is noted during the thermal testing.

In all of the fabrics for use in forming fire resistant safety apparel, as disclosed in the present application, the corespun yarn 10 includes three components, namely, a core 11 of high temperature resistant fibers with the fibers extending primarily in an axial or longitudinal direction of the yarn, a core wrapper 12 of low temperature resistant fibers surrounding and covering the core 11 and with the fibers extending primarily in the axial or longitudinal direction of the yarn, and an outer sheath 13 of low temperature resistant fibers surrounding and covering the core wrapper 12 and with these fibers extending primarily in a circumferential direction around the corespun yarn. The high temperature resistant fibers of the core 11 are selected from the group consisting essentially of aramid fibers and polybenzimidazole fibers and remain intact even when the fabric formed of this yarn is subjected to a high temperature flame. The fibers of the core wrapper 12 extending in the axial direction of the yarn add tensile strength to the yarn and surround and cover the core 11 to provide a base for applying the fibers of the outer sheath 13 thereto. The fibers of the outer sheath 13 completely surround and cover the core wrapper 12 and the core 11 and provide the desired surface characteristics to the fabric formed of these corespun yarns. When a fabric formed of the present corespun yarn is subjected to high temperature flame environment, the fibers of the core wrapper 12 and the outer sheath 13 are burned and become charred but remain in position around the core 11 and maintain substantially the same flexibility and integrity as the unburned fabric.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A corespun yarn for forming fire resistant safety apparel comprising a core of high temperature resistant staple fibers selected from the group consisting of aramid fibers and polybenzimidazole fibers, a core wrapper of low temperature resistant staple fibers surrounding and covering said core, an outer sheath of low temperature resistant staple fibers surrounding and covering said core wrapper, and wherein the fibers of said core and said core wrapper extend primarily in an axial or longitudinal direction along said corespun yarn, and wherein said fibers of said outer sheath extend primarily in a circumferential direction around said corespun yarn.

2. A corespun yarn according to claim 1 wherein said core of high temperature resistant fibers constitutes about 20% to 25% of the total weight of said corespun yarn, wherein said core wrapper of low temperature resistant fibers constitutes about 30% to 65% of the total weight of said corespun yarn, and wherein said outer sheath of low temperature resistant fibers constitutes about 20% to 50% of the total weight of said corespun yarn.

3. A corespun yarn according to claim 2 wherein said core of high temperature resistant fibers constitutes about 20% of the total weight of said corespun yarn, wherein said core wrapper of low temperature resistant fibers constitutes about 30% of the total weight of said corespun yarn, and wherein said outer sheath of low temperature resistant fibers constitutes about 50% of the total weight of said corespun yarn.

4. A corespun yarn according to claim 1 wherein said core wrapper and said outer sheath constitute the same type of fibers.

5. A corespun yarn according to claim 1 wherein said core wrapper and said outer sheath constitute different types of fibers.

6. A corespun yarn according to claim 1 wherein said core wrapper and said outer sheath each comprise cotton fibers.

7. A corespun yarn according to claim 1 wherein said core comprises 40% by weight of polybenzimidazole fibers and 60% by weight of aramid fibers.

8. A corespun yarn according to claim 1 wherein said core is comprised entirely of aramid fibers.

* * * * *